US010132446B2

(12) United States Patent
Joh et al.

(10) Patent No.: US 10,132,446 B2
(45) Date of Patent: Nov. 20, 2018

(54) REINFORCING MEMBER FOR CORRUGATED MEMBRANE OF LNG CARGO TANK, MEMBRANE ASSEMBLY HAVING THE REINFORCING MEMBER AND METHOD FOR CONSTRUCTING THE SAME

(71) Applicant: Samsung Heavy Ind. Co., Ltd., Seoul (KR)

(72) Inventors: Ki-Hun Joh, Geoje-Si (KR); Sang-Eon Chun, Geoje-Si (KR); Chang-Seon Bang, Geoje-Si (KR); Dai-Gil Lee, Daejeon (KR); Byung-Chul Kim, Busan (KR); Bu-Gi Kim, Gwangju (KR); Jin-Gyu Kim, Changwon-si (KR); Soon-Ho Yoon, Incheon (KR); San-Wook Park, Gwangju (KR); Kwan-Ho Lee, Seoul (KR); Seong-Su Kim, Geoje-Si (KR); Byoung-Jung Kim, Jeollabuk-do (KR); Po-Chul Kim, Gyeongsangbuk-do (KR); Ha-Na Yu, Mungyeong-si (KR); Yong-Suk Suh, Geoje-Si (KR); Sang-Min Han, Geoje-Si (KR); Jong-Won Yoon, Geoje-Si (KR); Jae-Yeon Choi, Geoje-Si (KR); Hee-Jin Son, Geoje-Si (KR)

(73) Assignee: SAMSUNG HEAVY IND. CO., LTD, Seoul (KR)

( * ) Notice: Subject to any disclaimer, the term of this patent is extended or adjusted under 35 U.S.C. 154(b) by 0 days.

(21) Appl. No.: 15/336,474

(22) Filed: Oct. 27, 2016

(65) Prior Publication Data

US 2017/0108169 A1 Apr. 20, 2017

Related U.S. Application Data

(60) Continuation of application No. 14/522,757, filed on Oct. 24, 2014, now abandoned, which is a division of (Continued)

(30) Foreign Application Priority Data

Mar. 3, 2008 (KR) ..... 10-2008-0019481
Jan. 5, 2009 (KR) ..... 10-2009-0000333
Feb. 6, 2009 (KR) ..... 10-2009-0009676

(51) Int. Cl.
*B63B 25/16* (2006.01)
*F17C 3/02* (2006.01)
*F17C 3/06* (2006.01)

(52) U.S. Cl.
CPC ..... *F17C 3/027* (2013.01); *B63B 25/16* (2013.01); *F17C 3/06* (2013.01);

(Continued)

(58) Field of Classification Search
CPC ..... F17C 2203/012; F17C 2203/0636; F17C 2203/0639; F17C 2203/0643;

(Continued)

(56) References Cited

U.S. PATENT DOCUMENTS 1,651,521 A * 12/1927 Lucas-Girardville ..... F17C 1/06 220/560.04
1,968,088 A * 7/1934 Mekler ..... B01J 19/0026 196/133

(Continued)

FOREIGN PATENT DOCUMENTS

BE 845670 A * 2/1977
EP 444371 A1 * 9/1991

(Continued)

OTHER PUBLICATIONS

Japanese Office Action dated Oct. 16, 2012, pp. 1-3.

(Continued)

*Primary Examiner* — Charles A Fox
*Assistant Examiner* — Charissa Ahmad
(74) *Attorney, Agent, or Firm* — Brinks Gilson & Lione

(57) ABSTRACT

The present invention is related to a reinforcing member for a membrane for improving the pressure-withstanding property of the membrane having corrugations, and a membrane assembly having the reinforcing member and a method of constructing the membrane assembly. By providing a reinforcing member for a membrane having corrugations and installed in an insulating structural member of an LNG cargo, the present invention can prevent the collapse of the corrugation and attenuate shocks against a same load without increasing the facial rigidity of the corrugation, and improve the insulating property by forming an additional insulating layer.

1 Claim, 25 Drawing Sheets

Related U.S. Application Data application No. 12/920,446, filed on Aug. 31, 2010, now abandoned, which is a continuation of application No. PCT/KR2009/001035, filed on Mar. 3, 2009.

(52) U.S. Cl.
CPC ..... *F17C 2203/012* (2013.01); *F17C 2203/0636* (2013.01); *F17C 2203/0639* (2013.01); *F17C 2203/0643* (2013.01); *F17C 2203/0646* (2013.01); *F17C 2203/0648* (2013.01); *F17C 2203/0651* (2013.01); *F17C 2205/0196* (2013.01); *F17C 2209/22* (2013.01); *F17C 2209/221* (2013.01); *F17C 2209/227* (2013.01); *F17C 2209/228* (2013.01); *F17C 2221/033* (2013.01); *F17C 2223/0153* (2013.01); *F17C 2223/0161* (2013.01); *F17C 2260/011* (2013.01); *F17C 2270/0107* (2013.01); *Y10T 29/49826* (2015.01); *Y10T 428/24661* (2015.01); *Y10T 428/2933* (2015.01)

(58) Field of Classification Search
CPC ..... F17C 2203/0646; F17C 2203/0648; F17C 2203/0651; F17C 2205/0196; F17C 2209/22; F17C 2209/221; F17C 2209/227; F17C 2209/228; F17C 3/027
See application file for complete search history.

(56) References Cited

U.S. PATENT DOCUMENTS 2,100,895 A * 11/1937 Austin ..... B65D 85/84 165/134.1
2,144,945 A * 1/1939 Sutton ..... B64D 37/02 220/560.06
2,373,270 A * 4/1945 Skolnik ..... A01K 7/00 119/72
2,393,964 A * 2/1946 Boardman ..... F17C 3/027 114/74 A
2,507,778 A * 5/1950 Frey ..... F17C 1/06 220/560.06
2,983,403 A * 5/1961 Mauser ..... B65D 11/06 220/62.22
2,993,571 A * 7/1961 Hawkins ..... E04D 3/3607 52/489.1
3,088,621 A * 5/1963 Brown ..... F17C 3/027 220/560.06
3,150,794 A * 9/1964 Schlumberger ..... A47J 41/028 220/560.03
3,166,829 A * 1/1965 Lemelson ..... B21D 53/045 220/669
3,335,903 A * 8/1967 Anderson ..... B65D 88/76 220/560.04
3,341,051 A * 9/1967 Forman ..... F17C 13/001 220/560.03
3,394,841 A * 7/1968 Anderson ..... B65D 90/022 220/62.19
3,400,849 A * 9/1968 Pottier ..... F17C 3/005 220/560.06
3,446,385 A * 5/1969 Ponemon ..... F17C 1/14 220/590
3,529,987 A * 9/1970 Lemelson ..... B29C 63/26 148/243
3,547,302 A * 12/1970 Massac ..... B63B 25/16 114/74 A
3,562,977 A * 2/1971 Alleaume ..... F17C 1/12 220/560.08
3,570,701 A * 3/1971 Yamamoto ..... B21D 1/00 220/560.05
3,661,294 A * 5/1972 Pearson ..... B65D 90/029 220/590
3,851,786 A * 12/1974 Kaempen ..... B29C 53/602 138/144
3,924,039 A 12/1975 Smith, Jr.
4,021,982 A * 5/1977 Kotcharian ..... F16L 59/02 220/592.26
4,155,207 A * 5/1979 Humphrey ..... E04H 7/24 52/223.3
4,201,745 A * 5/1980 Zickgraf ..... B01J 3/04 162/233
4,371,288 A * 2/1983 Borca ..... B65D 90/046 405/150.1
4,549,672 A * 10/1985 Rinkewich ..... B65D 11/16 220/639
4,676,093 A * 6/1987 Pugnale ..... B65D 88/76 220/560.03
4,739,659 A * 4/1988 Sharp ..... B65D 90/501 220/560.03
4,778,075 A * 10/1988 Wiegand ..... B65D 90/02 220/62.19
4,781,777 A * 11/1988 Pugnale ..... B65D 88/76 156/187
5,002,195 A * 3/1991 Lasson ..... B65D 90/042 220/4.12
5,046,531 A * 9/1991 Kanao ..... F16L 9/147 138/122
5,115,936 A * 5/1992 Bartlow ..... B65D 90/501 220/567.1
5,299,405 A * 4/1994 Thompson ..... E04C 2/322 29/455.1
5,320,247 A * 6/1994 Sharp ..... B65D 90/028 220/4.12
5,347,787 A * 9/1994 Gavin ..... E04C 5/203 248/74.3
5,375,735 A * 12/1994 Huvey ..... B29C 53/805 220/23.87
5,444,959 A * 8/1995 Tesch ..... B29D 24/00 156/84
5,462,191 A * 10/1995 Bartlow ..... B65D 90/501 220/62.11
5,522,340 A * 6/1996 Skogman ..... B63B 5/24 114/357
5,628,425 A * 5/1997 Sharp ..... B29C 53/8075 220/560.03
5,659,941 A * 8/1997 Huvey ..... B21D 51/24 29/421.1
6,145,692 A * 11/2000 Cherevatsky ..... F17C 1/04 220/581
6,510,961 B1 * 1/2003 Head ..... D04C 1/06 220/590

(56) References Cited

U.S. PATENT DOCUMENTS

| | | | | |
|---|---|---|---|---|
| 6,547,092 | B1 * | 4/2003 | Chervatsky | F17C 1/00 220/581 |
| 6,595,269 | B2 * | 7/2003 | Mitchell | F28D 15/0233 165/104.26 |
| 6,648,167 | B1 * | 11/2003 | Brupbacher | B32B 15/08 220/4.13 |
| 6,820,762 | B2 * | 11/2004 | Berg, Sr. | F17C 1/08 220/560.03 |
| 7,861,969 | B2 * | 1/2011 | Guzman | B29C 43/10 244/119 |
| 2005/0006394 | A1 * | 1/2005 | Fujihara | F17C 1/06 220/581 |
| 2005/0082297 | A1 * | 4/2005 | Dhellemmes | B63B 3/68 220/562 |
| 2007/0246473 | A1 * | 10/2007 | Yang | F17C 13/001 220/565 |
| 2009/0152278 | A1 * | 6/2009 | Lindner | F17C 1/00 220/589 |

FOREIGN PATENT DOCUMENTS

| | | | | |
|---|---|---|---|---|
| EP | 1847758 | A2 * | 10/2007 | F17C 13/001 |
| FR | 2936784 | A1 * | 4/2010 | |
| FR | 2936784 | A1 * | 4/2010 | F17C 3/027 |
| FR | 2963818 | A1 * | 2/2012 | |
| JP | 50142214 | | 11/1975 | |
| JP | 53160816 | * | 5/1977 | |
| JP | 53160816 | | 12/1978 | |
| JP | 55078896 | | 6/1980 | |
| JP | 55102496 | | 7/1980 | |
| JP | 55122600 | | 8/1980 | |
| JP | 59100243 | | 7/1984 | |
| JP | 04153407 | A * | 5/1992 | |
| JP | 59118586 | | 7/1994 | |
| JP | 3177700 | | 8/1994 | |
| JP | 2002181288 | | 6/2002 | |
| JP | 2004347478 | | 12/2004 | |
| JP | 2004347478 | A * | 12/2004 | |
| JP | 2006017213 | A | 1/2006 | |
| JP | 2012111558 | A * | 6/2012 | F17C 3/027 |
| JP | 2012144298 | A * | 8/2012 | F17C 3/027 |

OTHER PUBLICATIONS

Office Action received in Chinese Application No. 200980108028.4 dated Oct. 19, 2012, pp. 1-6.

Office Action received in Japanese Application No. 2010-546708 dated Nov. 5, 2018, pp. 1-3.

Office Action in Japanese Application No. 2014-076641 dated Apr. 28, 2015, including an English translation.

Transmittal of and Supplementary European Search Report received in European Application No. EP 09718329 dated Nov. 10, 2016.

* cited by examiner

Without reinforcement

-163℃

Reinforced with foam

-163℃

Without reinforcement

-163℃, 0.7 MPa collapsed

Reinforced with foam

-163℃, 0.7 MPa

REINFORCING MEMBER FOR CORRUGATED MEMBRANE OF LNG CARGO TANK, MEMBRANE ASSEMBLY HAVING THE REINFORCING MEMBER AND METHOD FOR CONSTRUCTING THE SAME

RELATED APPLICATIONS

This application is a continuation of U.S. application Ser. No. 14/522,757 filed on Oct. 24, 2014, which is a divisional of U.S. patent Ser. No. 12/920,446, filed Aug. 31, 2010, which is a continuation of PCT/KR09/01035, filed Mar. 3, 2009, which claims the benefit of Korean Patent Applications Nos. 10-2009-0009676 filed on Feb. 6, 2009, 10-2009-0000333 filed on Jan. 5, 2009, and 10-2008-0019481 filed on Mar. 3, 2008, the disclosures of which are incorporated herein in its entirety by reference.

TECHNICAL FIELD

The present invention is related to a reinforcing member for a corrugated membrane of an LNG cargo tank, more specifically to a reinforcing member for improving the pressure resistance property of a membrane having corrugation, a membrane assembly having the reinforcing member and a method of constructing the membrane assembly.

BACKGROUND ART

LNG (liquefied natural gas) generally refers to colorless, transparent cryogenic liquid converted from natural gas (predominantly methane) that is cooled to approximately −163° C. and condensed to $1/600^{th}$ the volume.

As LNG emerges as an energy source, efficient transportation means have been sought in order to transport LNG from a supply site to a demand site in a large scale so as to utilize LNG as energy. Resulted in a part of this effort is LNG carriers, which can transport a large quantity of LNG by sea.

LNG carriers need to be furnished with a cargo that can keep and store cryogenically liquefied LNG, but such carriers require intricate and difficult conditions. That is, since LNG has vapor pressure that is higher than atmospheric pressure and boiling point of approximately −163° C., the cargo that stores LNG needs to be constructed with materials that can withstand very low temperature, for example, aluminum steel, stainless steel and 33% nickel steel, and designed in a unique insulation structure that can withstand thermal stress and thermal contraction and can be protected from heat leakage, in order to keep and store LNG safely.

Particularly, membranes, which are the primary barrier of the cargo, are in direct contact with the cryogenic LNG with its temperature of −163° C., and thus are made of metallic materials, such as aluminum alloy, the Invar, 9% nickel steel, etc., which are strong against brittleness at a low temperature and can address changes in stress. Membranes also have linear corrugations, in which the center is bulged, in order to allow easier expansion and contraction in response to repeated changes in temperature and change in the weight of the stored liquid. In addition, membranes have weld zones that help keep the tank leak-proof by fold-welding edges of a plurality of membrane panels.

In the conventionally-used membranes, the membranes are made in an approximately rectangular shape, and a plurality of corrugations are formed throughout the membrane panels in order to facilitate expansion and contraction in response to heat and load. Moreover, corners and 4 sides of a single membrane panel, which encompasses the plurality of corrugations, are overlapped and connected by welding with corners and 4 sides of neighboring membrane panels to make the tank leak-proof.

However, since the corrugations of the conventional membranes are bulged, the membranes are expected to collapse easily under increased hydrostatic or dynamic pressure in the cargo as LNG carriers become increasingly bigger. For example, the hydrostatic pressure applied by liquefied gas may cause considerable plastic deformation of the corrugations, and particularly, lateral faces of the corrugations that are at a certain distance away from intersecting corrugations may be crushed.

There have been a number of efforts to reinforce the rigidity of the corrugations, for example, increasing the thickness of the membrane, but these efforts have had problems such as decreased flexibility. As illustrated in FIG. 1 and FIG. 2, US2005/0082297 discloses a sealed wall structure including at least one membrane 10, in which a series of first corrugations 5 and a series of second corrugations 6, the directions of which are perpendicular, are formed in the membrane, in which the corrugations 5, 6 protrude toward an internal face of a tank, in which the sealed wall structure includes at least one reinforcing ridge 11 formed on at least one corrugation midway between two intersections 8 with the other series of corrugations, and in which each ridge 11 is generally convex and is locally formed on at least one lateral face of the corrugation supporting the ridge.

However, as illustrated in FIG. 2, the corrugations, the facial rigidity of which is increased by the reinforcing ridge, of the conventional membrane described above may not properly function to expand and contract as expected when force is exerted on the corrugation in the direction of the arrow, thereby increasing the stress in the weld zones during thermal contraction. Moreover, since the parts that do not receive pressure or receive little pressure do not need the reinforcing ridge, membranes with reinforcing ridges and membranes without reinforcing ridges both need to be provided and arranged properly during the construction.

DISCLOSURE

Technical Problem

The present invention provides a reinforcing member for a membrane that can prevent the collapse of corrugations without increasing the facial rigidity of the corrugations by being placed inside the corrugations of the membrane, as well as a membrane assembly having the reinforcing member and a method of constructing the membrane assembly.

Technical Solution

An aspect of the present invention features a reinforcing member for a membrane installed in an insulating structural member of an LNG cargo and having a corrugation, the reinforcing member being disposed between the insulating structural member and the corrugation and reinforcing the rigidity of the corrugation.

A material of the reinforcing member can be nonflammable foam. A sectional shape of the reinforcing member can be a circle or can be identical to a sectional shape of the corrugation.

The reinforcing member can also include a reinforcing pipe installed inside the corrugation, and the reinforcing member can be mounted in the reinforcing pipe and installed inside the corrugation. Here, a sectional shape of the pipe can be a circle or can be identical to a sectional shape of the corrugation.

Another aspect of the present invention features a reinforcing member for a membrane installed in an insulating structural member of an LNG cargo and having a corrugation, which can include a reinforcing member installed inside the corrugation so as to prevent deformation of the corrugation. The reinforcing member can be formed with a path through which gas injected for a leak test or dehumidification of the corrugation can flow.

Here, a material of the reinforcing member can be non-flammable foam or a wooden material.

A sectional shape at either end of the reinforcing member can be identical to a sectional shape of the corrugation. The path can be a hemispherical or polygonal shape depressed in a lengthwise direction of the reinforcing member. The path can include a first path formed on an upper surface of the reinforcing member and a second path formed on a lower surface of the reinforcing member.

Yet another aspect of the present invention features a reinforcing member for a membrane for reinforcing the rigidity of a corrugation furnished in a membrane coupled to an insulating structural member, the reinforcing member being disposed between the insulating structural member and the corrugation, the reinforcing member including: a bottom portion the external face of which is flat so that the bottom portion can be in contact with the insulating structural member; a supporting portion having an external face corresponding to an internal face of the corrugation so that the supporting portion can be in contact with the internal face of the corrugation; and a reinforcing body in a shape of a pipe, the pipe having a cross section of a closed curve.

The reinforcing member can also include a supplementary reinforcing means disposed inside the reinforcing body and supporting an internal face of the reinforcing member. The supplementary reinforcing means can include a reinforcing pipe the cross section of which is a circular shape. The supplementary reinforcing means can include a plurality of reinforcing spokes radially extended from a center of the reinforcing body toward an outside of the reinforcing body so that the supplementary reinforcing means can be in contact with an internal face of the reinforcing body.

The reinforcing member can also include an insulating member disposed inside the reinforcing body and improving an insulating property. A path through which gas injected for a leak test or dehumidification of the corrugation can flow can be formed inside the insulating member.

A surface hardness of the reinforcing body can be lower than that of the membrane. The reinforcing member can also include a buffering member coupled to an external face of the reinforcing body and attenuating impact loadings.

The reinforcing body can include an insertion hole for coupling with the insulating structural member. The reinforcing member can also include a pressing-in means disposed at an end of the reinforcing body so that the pressing-in means can be in contact with an internal face of the corrugation and plastically deformed to fix the reinforcing body inside the corrugation. The pressing-in means can be formed by deforming a portion of the reinforcing body so that the pressing-in means can be in contact with an inside of the corrugation and plastically deformed.

The reinforcing member can also include an extension extended from an end of the bottom portion of the reinforcing body toward an outside. The pressing-in means can include a coil portion, which is wound on the extension, and a pair of arms extended from either end of the coil portion toward an internal face of the corrugation so that the arms can be in contact with the internal face of the corrugation and plastically deformed.

Still another aspect of the present invention features a membrane assembly, which can include: an insulating structural member having a flat surface; a membrane coupled to the flat surface of the insulating structural member and having a plurality of corrugations protruded toward an outside; and a reinforcing member disposed between the insulating structural member and the corrugation and including a bottom portion, an external face of the bottom portion being flat so as to be in contact with the insulating structural member, and a supporting portion having an external face corresponding to an internal face of the corrugation so as to be in contact with the internal face of the corrugation, and a reinforcing body in a shape of a pipe, a cross section of the pipe being a closed curve.

The reinforcing member can include an insertion hole, and the membrane assembly can also include a fixing means coupled to the insulating structural member by penetrating the insertion hole in order to fix the reinforcing member to the insulating structural member.

A concavity caved in toward the insulating structural member can be formed at an end of the corrugation, and an end of the reinforcing body can be furnished with a pressing-in means being in contact with an internal face of the concavity and plastically deformed so that the reinforcing body can be fixed inside the corrugation.

Another aspect of the present invention features a method of constructing a membrane assembly including a membrane having a corrugation and an insulating structural member having a flat surface to which the membrane is couple. The method in accordance with an embodiment of the present invention can include: a) disposing a reinforcing member between an internal face of the corrugation and the surface of the insulating structural member, the reinforcing member including a bottom portion and a supporting portion, the bottom portion having an external face corresponding to the surface of the insulating structural member, the supporting portion having an external face corresponding to the internal face of the corrugation; and b) coupling the membrane to the surface of the insulating structural member so that the internal face of the corrugation is in contact with an external face of the reinforcing member.

The step of a) cab include adhering the reinforcing member to one of the internal face of the corrugation and the surface of the insulating structural member by use of an adhesive.

The step of a) can include fixing the reinforcing member to the surface of the insulating structural member by inserting a fixing means protruded from one of the insulating structural member and the reinforcing member into the other of the insulating structural member and the reinforcing member.

The step of a) can include pressing in the reinforcing member into the corrugation by allowing a portion of the reinforcing member to be in contact with the internal face of the corrugation and plastically deforming the portion of the reinforcing member.

Advantageous Effects

As described above, the reinforcing member for a membrane in accordance with the present invention can prevent the collapse of the corrugation and attenuate shocks without increasing the facial rigidity of the corrugation of the membrane, and improve the insulating property by forming an additional insulating layer.

Moreover, the reinforcing member for a membrane in accordance with the present invention can allow a more accurate leak test by providing fluidity of gas injected for the purpose of a leak test or dehumidification.

Furthermore, the reinforcing member for a membrane in accordance with the present invention can improve the impact attenuation property by providing a buffering member with a polymer material on an external face of the reinforcing member.

MODE FOR INVENTION

Figure 1:
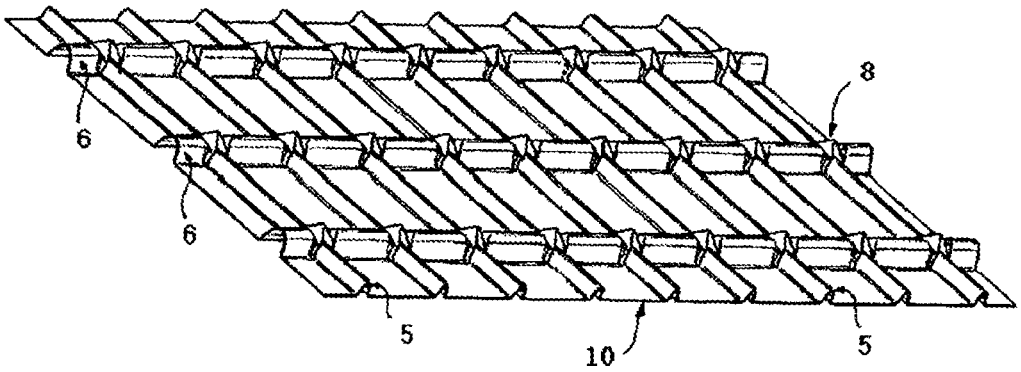
FIG. 1 is a perspective view of a conventional membrane.
Figure 2:
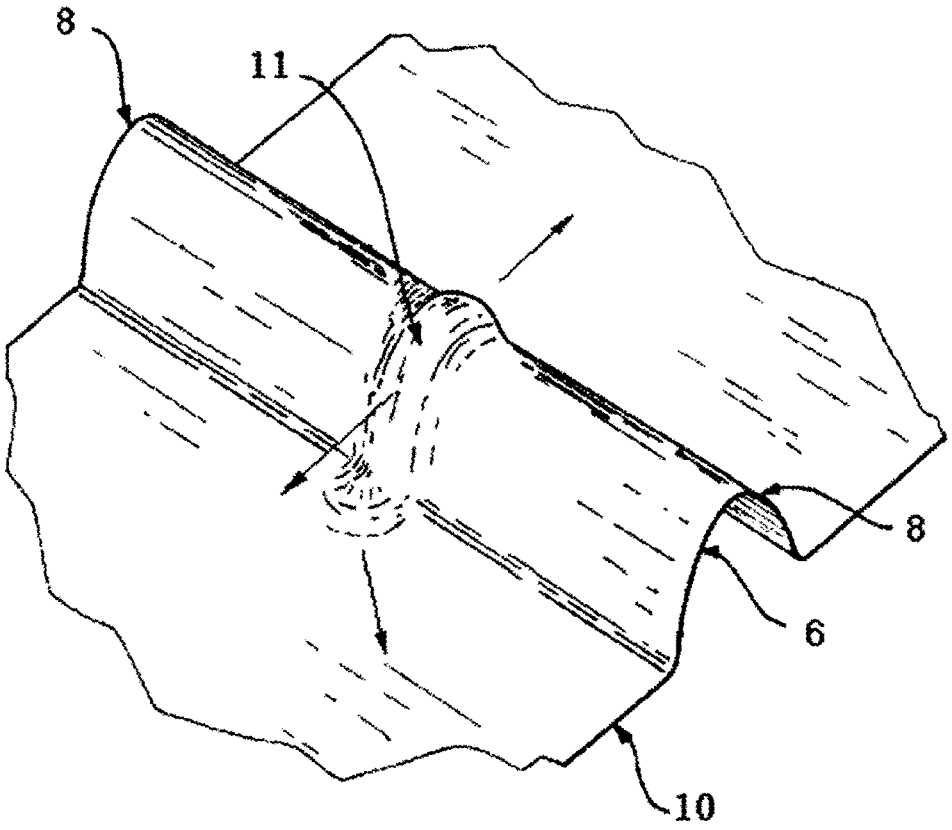
FIG. 2 is a magnified perspective view of a portion of a membrane in accordance with the related art.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the ideas and scope of the present invention. Throughout the description of the present invention, when describing a certain technology is determined to evade the point of the present invention, the pertinent detailed description will be omitted.

Hereinafter, certain embodiments of the present invention will be described in detail with reference to the accompanying drawings. Identical or corresponding elements will be given the same terms and the same reference numerals, regardless of the figure number, and any redundant description of the identical or corresponding elements will not be repeated.

Figure 3:
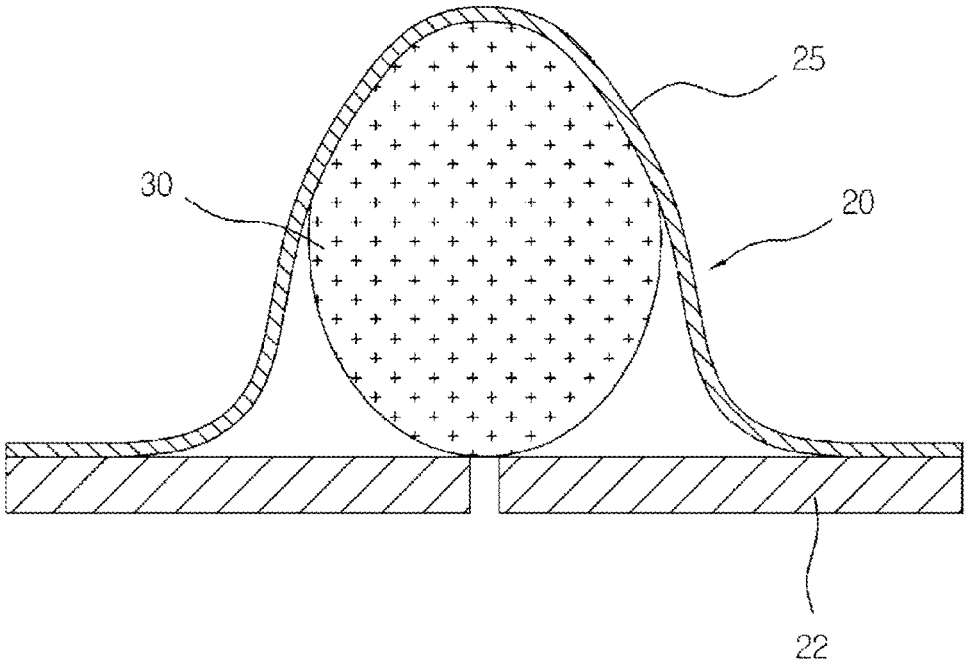
FIG. 3 to FIG. 4 are sectional views illustrating reinforcing members for a membrane in accordance with a first embodiment of the present invention.
Figure 4:
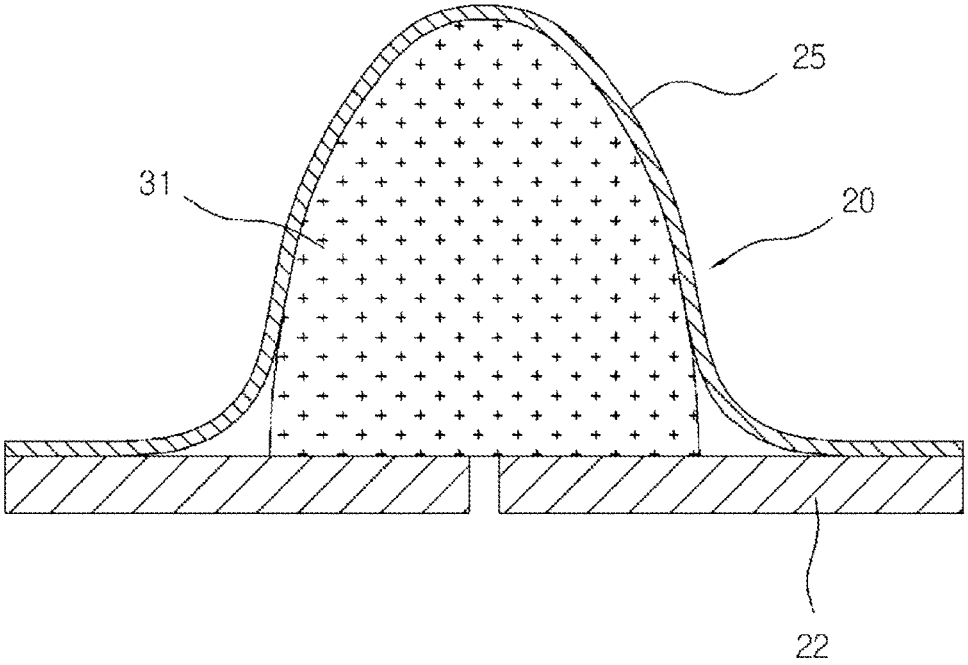
Figure 5:
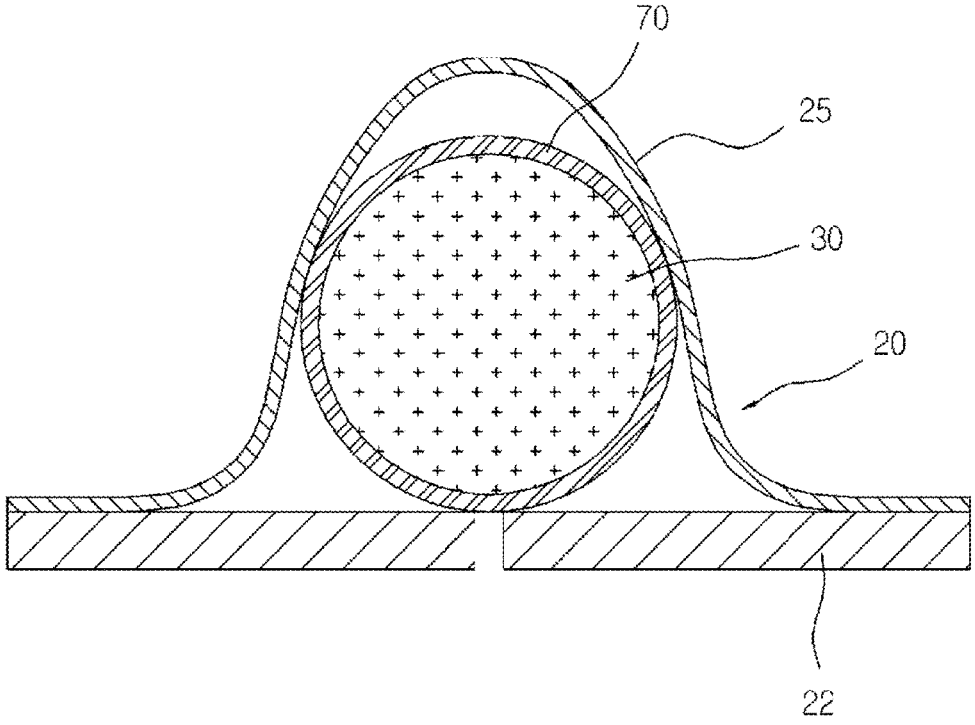
FIG. 5 to FIG. 6 are sectional views illustrating reinforcing members for a membrane in accordance with a second embodiment of the present invention.
Figure 6:
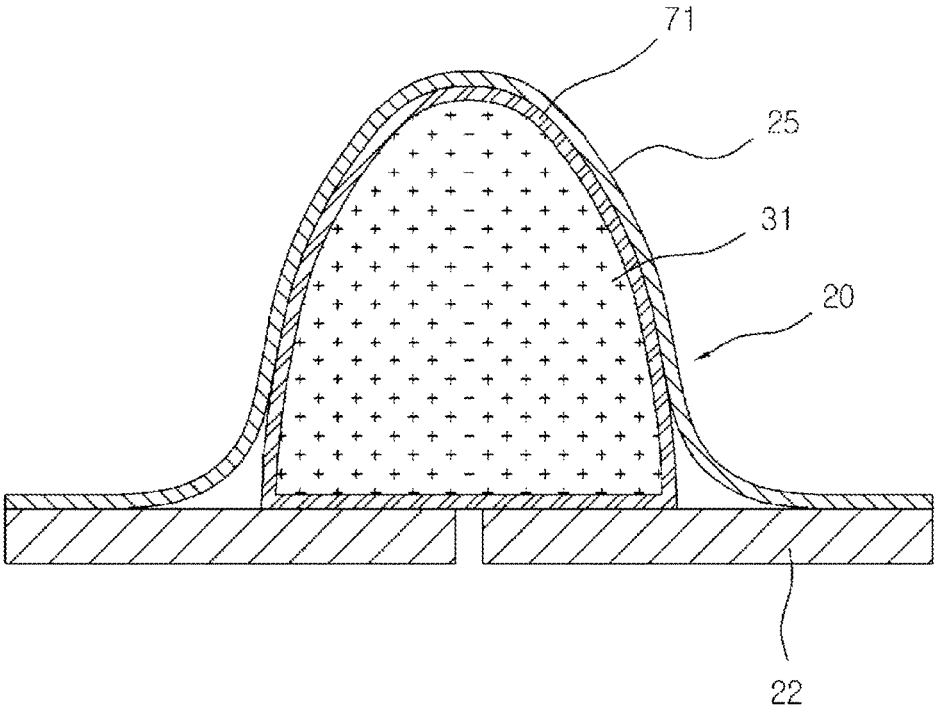

FIG. 3 to FIG. 4 are sectional views illustrating reinforcing members for a membrane in accordance with a first embodiment of the present invention, and FIG. 5 to FIG. 6 are sectional views illustrating reinforcing members for a membrane in accordance with a second embodiment of the present invention.

Described with reference to FIG. 1, a membrane 10 constituting a primary barrier in an LNG cargo is made in a rectangular shape and makes direct contact with the cryogenic state of LNG with the temperature of −163° C., and thus metallic materials such as aluminum alloy, the Invar and 9% nickel steel that are strong against brittleness at a low temperature and can address changes in stress are used. The membrane 10 includes at least one first corrugation 5 and at least one second corrugation 5, the respective directions of which are orthogonal, and an intersection 8 of the first corrugation 5 and the second corrugation 6, the corrugations 5, 6 being protruded toward an internal face of the cargo.

Here, in accordance with the feature of the present invention, a reinforcing member 30, 31 having a particular shape is filled inside the corrugation in order to complement the rigidity of the corrugation.

While it can be preferable that the reinforcing member 30, 31 is filled in the lengthwise direction of a corrugation 25 such as the first corrugation 5 and the second corrugation 6, it is more preferable that the reinforcing member 30, 31 is filled in the second corrugation only in order to meet the required rigidity.

For the reinforcing member 30, 31, phenol foam or other nonflammable foams can be used. As illustrated in FIGS. 3 and 4 as the first embodiment, the reinforcing member 30, 31 can have a circular shape or a shape corresponding to the sectional shape of the first and second corrugations 5, 6.

Meanwhile, in case a greater rigidity than the reinforcing member 30, 31 made of nonflammable foam is required, the reinforcing member 30, 31 can be made of synthetic resin, which is then mounted in a pipe 70, 71, the interior of which is hollow, and installed inside the corrugations together with the pipe 70, 71.

The pipe 70, 71 made by adding, for example, glass fiber in synthetic resin can be also installed lengthwise in both the first corrugation 5 and the second corrugation 6 or in the second corrugation 6 only.

As illustrated in FIGS. 5 and 6 as the second embodiment, the pipe 70, 71 can have a sectional shape that is circular or corresponds to the sectional shape of the first and second corrugations 5, 6, or any other shapes that can fill the inside of the second corrugation 6 are possible.

The membrane of an LNG cargo with the aforementioned structured functions as described below with reference to FIGS. 22A to 22D.

Figure 22A:
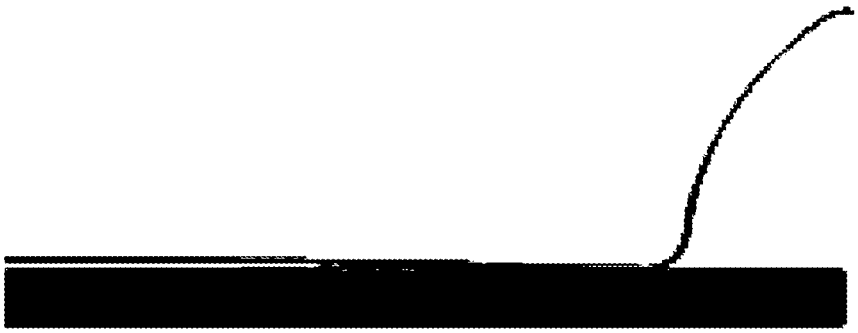
FIGS. 22A to 22D are diagrams representing the corrugation of the conventional membrane and the corrugation with the inside filled with the reinforcing member.
Figure 22B:
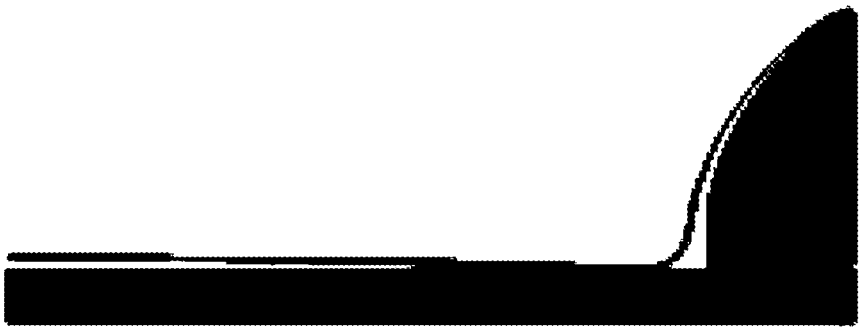
Figure 22C:
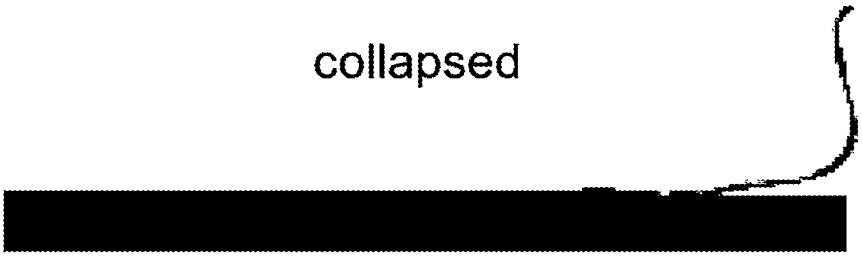
Figure 22D:
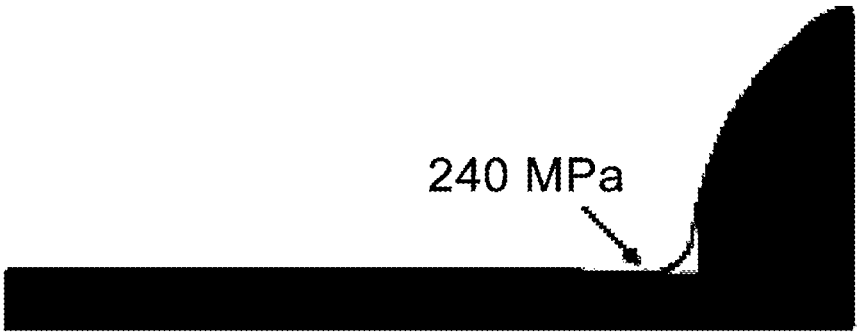

Here, FIGS. 22A and 22C represent a corrugation of the conventional membrane, and FIGS. 22B and 22D represent the corrugation with the inside filled with the reinforcing member 30, 31 of nonflammable foam.

These diagrams show results of interpreting deformation and stress in a cryogenic condition, while it is assumed that the nonflammable foam used as the reinforcing member 30, 31 has the rigidity of 140 MPa and the coefficient of thermal expansion of $53\times10^{-6}$ m/m° C. at an ultralow temperature, that its lower portion is in contact with an insulating structural member 22, and both ends of the primary barrier is symmetric.

Referring to FIGS. 22A and 22B that illustrate deformations of the corrugation in a cryogenic state in the aforementioned conditions, the un-reinforced corrugation shown in FIG. 22A is contracted and expanded according to temperature change and thus can maintain the structural shape of the membrane 10 but can be vulnerable to shocks. On the contrary, in the corrugation reinforced by the reinforcing member shown in FIG. 22B, since the coefficient of thermal expansion of the reinforcing member of nonflammable foam is greater than that of the corrugation, a gap is formed between the corrugation and the reinforcing member, and the corrugation that is contracted and expanded through this gap is not affected. It can be inferred in FIG. 22B that the rigidity of the corrugation is complemented and the insulating efficiency is also improved through the reinforcing member while the corrugation fully performs its inherent function.

FIGS. 22C and 22D illustrate the deformation and stress of the corrugation when the hydrostatic pressure of 7 bar is applied. While the lateral face of the un-reinforced corrugation shown in FIG. 22C is caved in and collapsed, collapse is prevented by pressure of the contact face between the inner face of the corrugation and the reinforcing member when the corrugation is reinforced by the reinforcing member as shown in FIG. 22D. That is, the maximum stress acting on the inside of the reinforcing member by the contact is approximately 0.8 MPa, which is sufficient to withstand the bearing pressure at an ultralow temperature.

Figure 7:
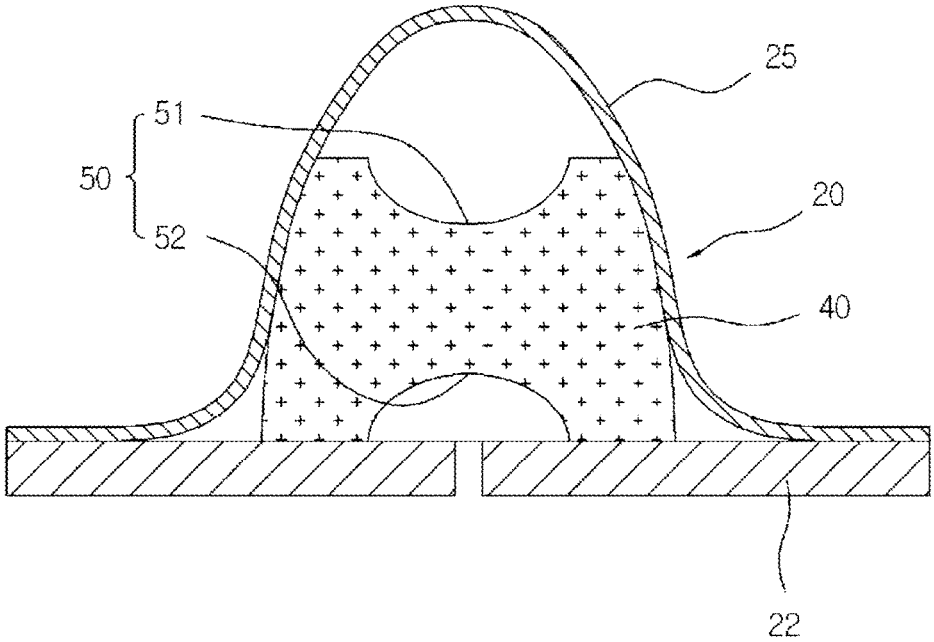
FIG. 7 is a sectional view illustrating a reinforcing member for a membrane in accordance with a third embodiment of the present invention.

FIG. 7 is a sectional view illustrating a reinforcing member for a membrane in accordance with a third embodiment of the present invention.

As described earlier, a membrane 20 forming the first barrier in an LNG carrier makes direct contact with the cryogenic LNG at the temperature of −163° C., and thus uses metallic materials such as aluminum alloy, the Invar and 9% nickel steel that are strong against brittleness at a low temperature and can handle the change in stress. Moreover, corrugations 25, the center of which is protruded, can be formed throughout a metal panel so that the membrane 10 can be readily expanded and contracted in a rectangular shape in response to the repeated change of temperature and the change in the load of the stored liquid.

The corrugations 25 are constituted by a first corrugation (see reference numeral 5 in FIG. 1) in the transverse direction and a second corrugation (see reference numeral 6 in FIG. 1) in a longitudinal direction. An intersection (see reference numeral 8 in FIG. 1) is formed where the first corrugation (see reference numeral 5 in FIG. 1) and the second corrugation (see reference numeral 6 in FIG. 1) intersect. The corrugations are protruded toward an internal face of the cargo.

Here, in order to reinforce the rigidity of the corrugations 25, a reinforcing member 40 is inserted and positioned inside the first corrugation (see reference numeral 5 in FIG. 1) and the second corrugation (see reference numeral 6 in FIG. 1), the reinforcing member 40 reaching the intersection (see reference numeral 8 in FIG. 1)

For the reinforcing member 40, nonflammable foam, such as phenol foam, and wooden material can be used. The sectional shape of the reinforcing member 40 can be a curved shape that is identical to the sectional shape of the inside of the corrugations 25 so that the reinforcing member 40 can be tightly fit in the corrugations 25. A path 50 can be formed on the reinforcing member 40.

The path 50 can be formed on an upper surface or a lower surface of the reinforcing member 40, and it is possible that a first path 51 is formed on the upper surface and the second path 52 is formed on the lower surface. Moreover, as illustrated in FIG. 7, the first path 51 and the second path 52 can be formed on a same reinforcing member.

The first path 51 and the second path 52 can be formed in a hemispherical concave shape or a polygonal concave shape along the lengthwise direction of the reinforcing member 40 in order to provide the fluidity of gas injected for dehumidification or leak-test of the membrane 20.

Described below is how the reinforcing member for a membrane described in the above structure works.

The hydrostatic pressure applied by liquid gas can cause a significant plastic deformation where no reinforcing member 40 is inserted in the corrugations 25. Therefore, in the present invention, the reinforcing member 40 made of nonflammable foam, such as phenol foam, or a wooden material is inserted and placed inside the first corrugation (see reference numeral 5 in FIG. 1) and the second corrugation (see reference numeral 6 in FIG. 1) up to the intersection (see reference numeral 8 in FIG. 1).

The reinforcing member 40 can be snuggly inserted inside the first corrugation (see reference numeral 5 in FIG. 1) and the second corrugation (see reference numeral 6 in FIG. 1) or can be wound with double-sided adhesive tape, although not illustrated, and adhered to the internal surfaces of the first corrugation (see reference numeral 5 in FIG. 1) and the second corrugation (see reference numeral 6 in FIG. 1). In another example, the membrane 20 can be turned inside out to place the reinforcing member 40 by temporary use of, for example, rubber band in order to prevent the reinforcing member 40 from disengagement from the membrane 20 when the membrane 20 is returned to the original side for installation.

Since the coefficient of thermal expansion of the reinforcing member 40 inserted inside the first corrugation (see reference numeral 5 in FIG. 1) and the second corrugation (see reference numeral 6 in FIG. 1) is greater than those of the first corrugation (see reference numeral 5 in FIG. 1) and the second corrugation (see reference numeral 6 in FIG. 1), a gap is formed between the reinforcing member 40 and the first and second corrugations (see reference numerals 5 and 6 in FIG. 1, respectively), and the first corrugation (see reference numeral 5 in FIG. 1) and the second corrugation (see reference numeral 6 in FIG. 1) that are contracted and expanded through this gap is not affected. The rigidity of the first corrugation (see reference numeral 5 in FIG. 1) and the second corrugation (see reference numeral 6 in FIG. 1) against shocks can be reinforced and the insulating efficiency can be also improved through the reinforcing member 40 while the first corrugation (see reference numeral 5 in FIG. 1) and the second corrugation (see reference numeral 6 in FIG. 1) fully perform their inherent function.

Moreover, by forming flow paths that allow the gas injected for a leak test or dehumidification of the membrane 20 to flow smoothly, the first path 51 and the second path 52 formed on the reinforcing member 40 can improve the reliability of the leak test and facilitate the dehumidification. Furthermore, the first path 51 and the second path 52 can reduce the overall weight of the reinforcing member 40 without affecting the structural rigidity of the reinforcing member 40.

Therefore, by inserting and placing the reinforcing member in the corrugations, deformation of the corrugations can be prevented, and gas injected for a leak test or dehumidification can be flowed so that a more accurate leak test can be performed and the insulating efficiency can be improved through dehumidification.

Figure 8:
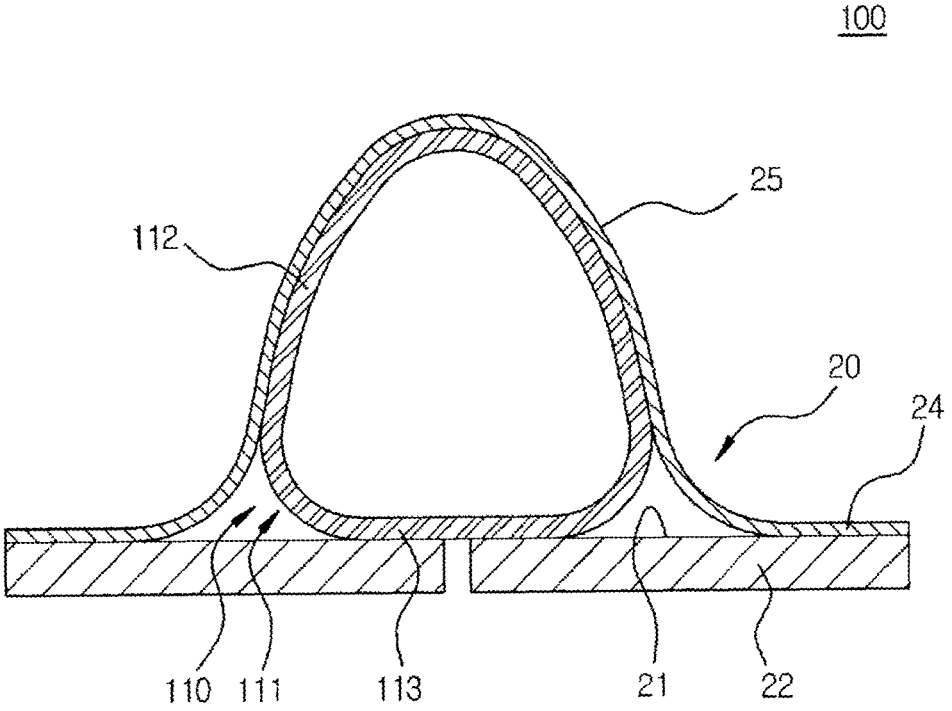
FIG. 8 is a sectional view illustrating a membrane assembly in accordance with a fourth embodiment of the present invention.

FIG. 8 is a sectional view illustrating a portion of a membrane assembly in accordance with a fourth embodiment of the present invention.

As illustrated in FIG. 8, a membrane assembly 100 in accordance with an embodiment of the present invention includes an insulating structural member 22 having a flat surface 21, a membrane 20 coupled to the surface of the insulating structural member 22 and having a corrugation 25 protruded to the outside, and a reinforcing member 110 placed inside the corrugation 25 and reinforcing the rigidity of the corrugation 25. The membrane 20 can be coupled to the surface 21 of the insulating structural member 22 by an adhesive method by use of an adhesive, by welding, or by a mechanical method by use of separate fixing means.

The membrane 20 has a flat portion 24, which is coupled to the surface 21 of the insulating structural member 22, and a plurality of corrugations 25, which are protruded to the outside of the insulating structural member 22. The membrane 20 is most commonly made of a metallic material, but can be made of other materials. The insulating structural member 22 can be made of plywood or other various materials so that it can form an insulating sealed wall together with the membrane 20.

The reinforcing member 110 functions to reinforce the rigidity of the corrugation 25, the plasticity of which can be more easily deformed than the flat portion 24 under high hydrostatic pressure or dynamic pressure. The reinforcing member 110 includes a reinforcing body 111, which includes a bottom portion 113 that is in contact with the surface 21 of the insulating structural member 22 and a supporting portion 112 that is in contact with the internal face of the corrugation 25. The external face of the bottom portion 113 is made flat so as to be tightly in contact with the surface 21 of the insulating structural member 22, and the external face of the supporting portion 112 is curved according to the shape of the internal face of the corrugation 25.

As the reinforcing member 110 is made in the shape of a pipe that has the cross-sectional shape of a closed curve, the reinforcing member 110 has a great structural rigidity and can stably support the internal face of the corrugation 25 against the pressure exerted to the corrugation 25. It is preferable that the reinforcing member 110 has lower hardness than the membrane 20 so as to reduce any damage by friction of the membrane 20.

For this, the reinforcing member 110 can be made of a material that has a lower hardness than that of the membrane 20. For example, in case the membrane 20 is made of stainless steel, the reinforcing member 110 can be made a material with lower hardness, for example, aluminum or brass. Alternatively, the surface hardness of the reinforcing member 110 can be lowered regardless of the material of the reinforcing member by coating the external face of the reinforcing member 110 with a low-hardness metal or polymer.

The reinforcing member 110 can maintain its adhesion state with the insulating structural member 22 without any additional coupling means because the reinforcing member 110 is pressed to the surface 21 of the insulating structural member 22 by the corrugation 25 when the membrane 20 is coupled to the surface 21 of the insulating structural member 22.

Figure 9:
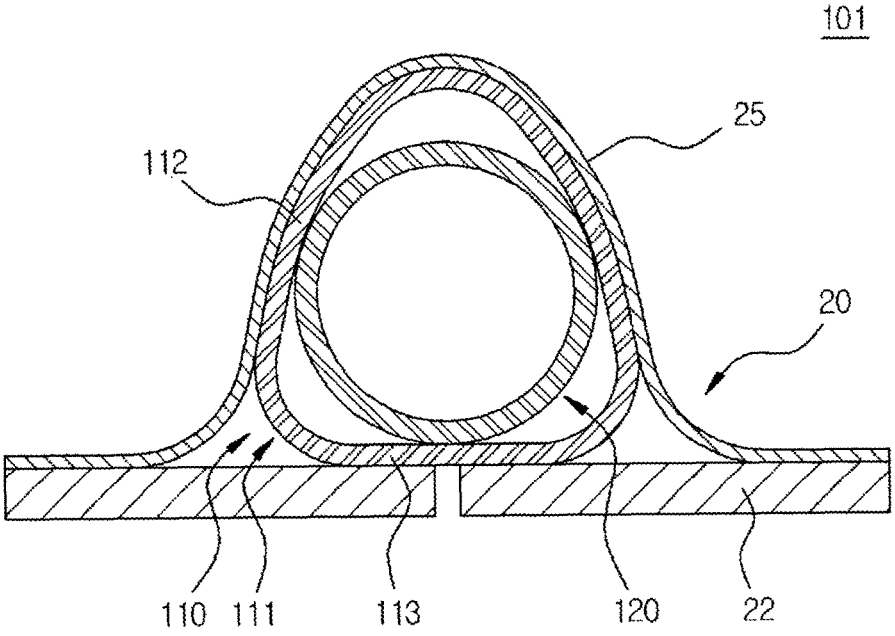
FIG. 9 to FIG. 16 are sectional views illustrating modifications of the membrane assembly in accordance with the fourth embodiment of the present invention.
Figure 10:
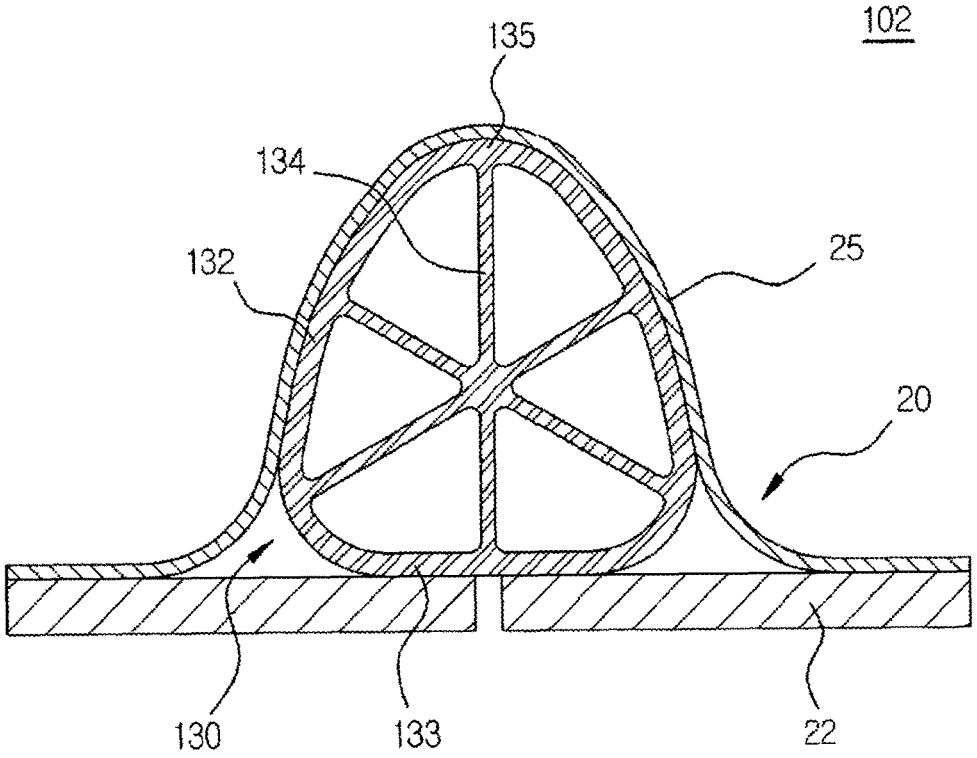

FIG. 9 and FIG. 10, which are portions of modification examples of the membrane assembly in accordance with the fourth embodiment of the present invention, illustrate that supplementary reinforcing means are added to the inside of the reinforcing member in order to increase the lateral rigidity of the reinforcing member. Since most of the structure of the membrane assembly is identical to the membrane assembly described with reference to FIG. 8, no redundant description will be provided herein.

A membrane assembly 101 shown in FIG. 9 includes the insulating structural member 22, the membrane 20 having the corrugation 25, the reinforcing member for reinforcing the rigidity of the corrugation 25, and a reinforcing pipe 120 placed inside the reinforcing member 110. The reinforcing pipe 120 has the cross-sectional shape of a circle and is placed inside the reinforcing member 110 to increase the lateral rigidity of the reinforcing member 110. The reinforcing pipe 120 supports the internal face of the reinforcing member 110 by making contact at three points of the internal face of the reinforcing member 110, namely, the internal face of the bottom portion 113 and the left and right internal faces of the supporting portion 112. Various materials that can support the internal face of the reinforcing member 110 can be used for the reinforcing pipe 120.

A membrane assembly 102 shown in FIG. 10 is furnished with a plurality of reinforcing spokes 134 inside a reinforcing member 130 as supplementary reinforcing means for improving the rigidity of the reinforcing member 130. The plurality of reinforcing spokes 134 are radially placed from the center of the reinforcing member 130 toward the internal face of the reinforcing member 130, making contact at the internal face of a bottom portion 133, the internal face of a top portion 135, and the left and right internal faces of a supporting portion 132. For the plurality of reinforcing spokes 134, metal or various materials that can improve the rigidity of the reinforcing member 130 by being in contact with the internal face of the reinforcing member 130 can be used.

The supplementary reinforcing means for improving the rigidity of the reinforcing member in accordance with the present invention are not restricted to the structures illustrated in FIGS. 9 and 10 and can be modified to other structures as long as they can be placed inside the reinforcing member and support the internal face of the reinforcing member.

Figure 11:
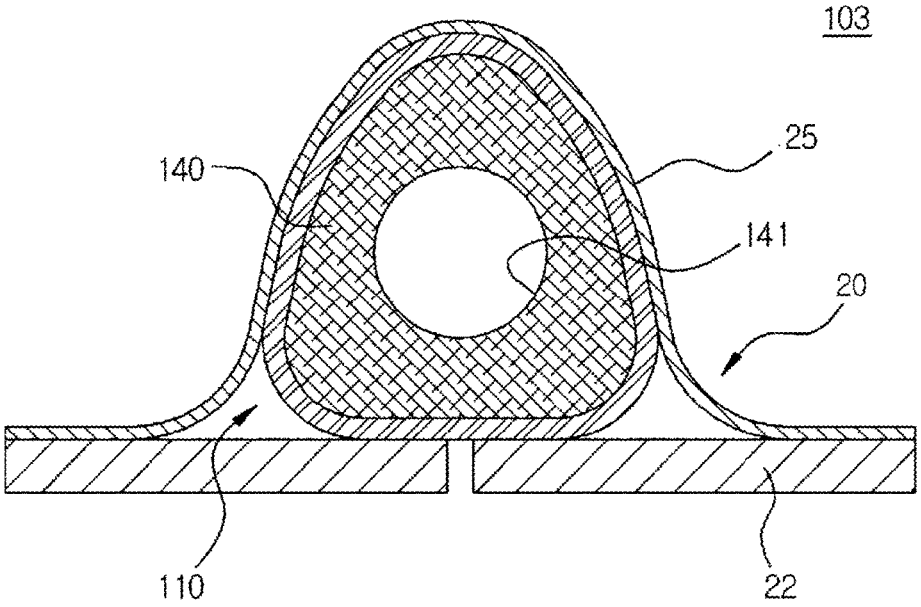
Figure 12:
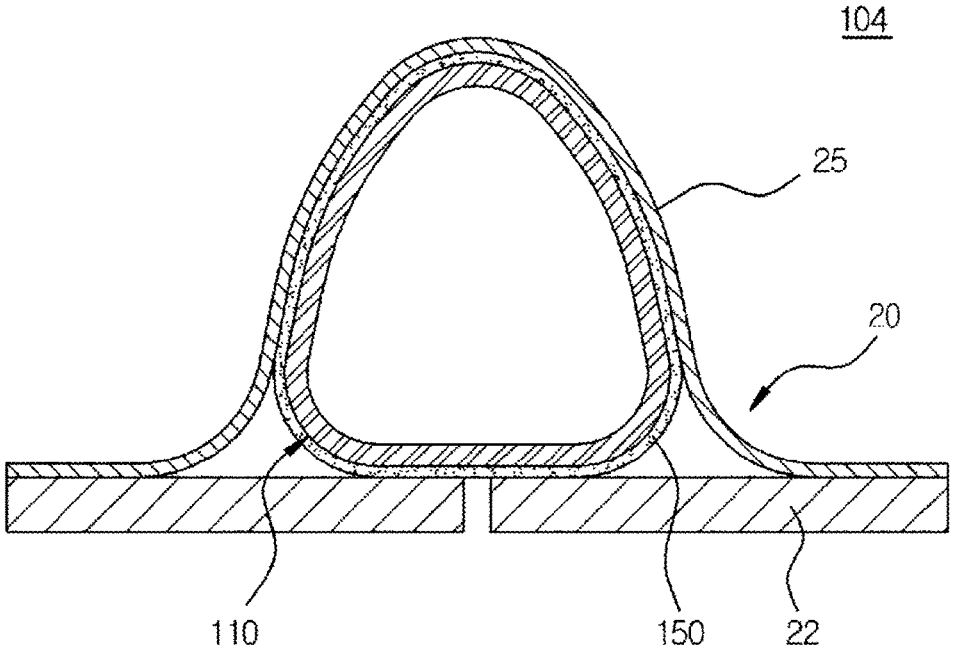
Figure 13:
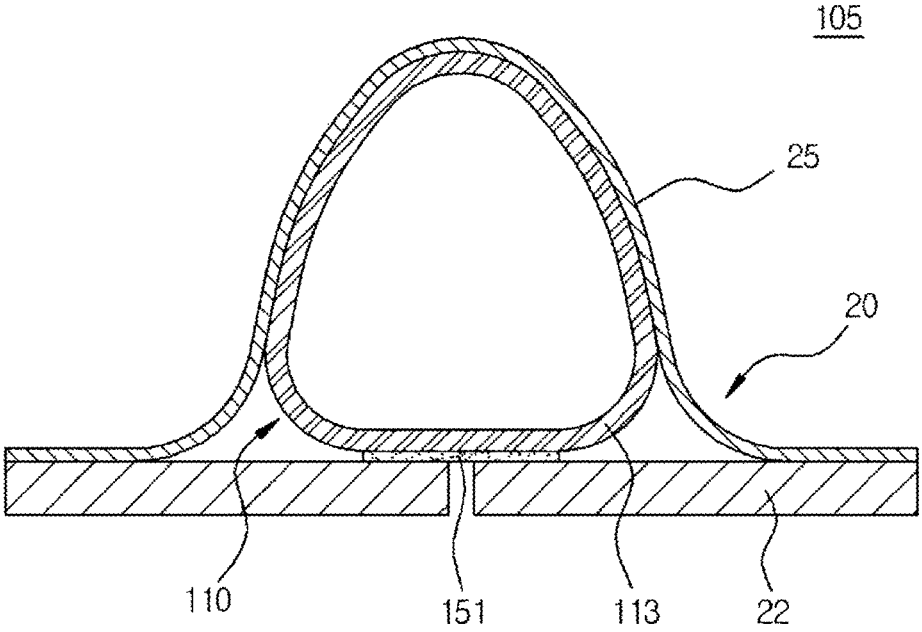

FIG. 11 to FIG. 13 illustrate respective portions of other examples of modification of the membrane assembly in accordance with the fourth embodiment of the present invention.

A membrane assembly 103 shown in FIG. 11 is furnished with an insulating member 140 filled inside the reinforcing member 110. For the insulating member 140, various materials with an insulating property, for example, urethane foam, can be used. The insulating member 140 not only improves the insulating property of the reinforcing member 110 but also improves the attenuation property against impact loadings.

Moreover, a path 141 is formed inside the insulating member 140 to allow a fluid, such as gas, injected for a leak test or dehumidification of the membrane 20 to flow through.

A membrane assembly 104 shown in FIG. 12 is furnished with a buffering member 150 on the external face of the reinforcing member 110. The buffering member 150 envelops the entire external face of the reinforcing member 110 and functions to attenuate impact loadings between the insulating structural member 22 and the bottom portion (refer to reference numeral 113 in FIG. 11) and between the corrugation 25 and the supporting portion 112.

Not only does the buffering member 150 attenuate impact loadings, but the buffering member 150 reduces friction between the reinforcing member 110 and the insulating structural member 22 and between the reinforcing member 110 and the corrugation 25, thereby preventing any damage on the surface of the reinforcing member. Used for the buffering member 150 can be a polymer coating layer or other various elastic materials.

A membrane assembly 105 shown in FIG. 13 is furnished with a buffering member at a portion of the external face of the reinforcing member 110. The buffering member 151 is placed at the bottom portion 113 of the reinforcing member 110 to attenuate impact loadings between the reinforcing member 110 and the insulating structural member 22 and prevent the external face of the bottom portion 113 from being damaged by friction against the insulating structural member 22.

Figure 14:
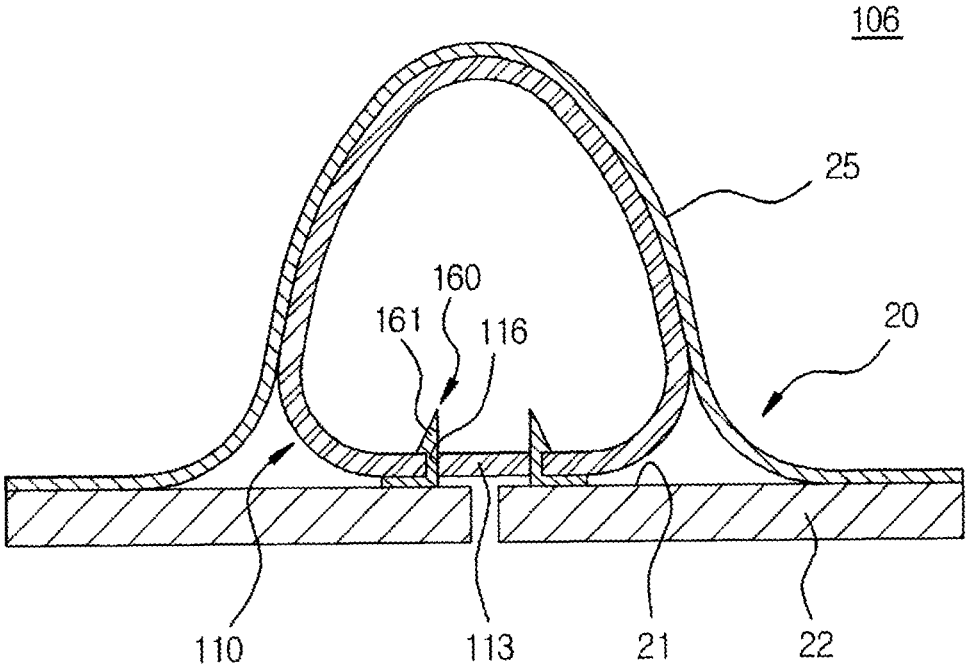
Figure 15:
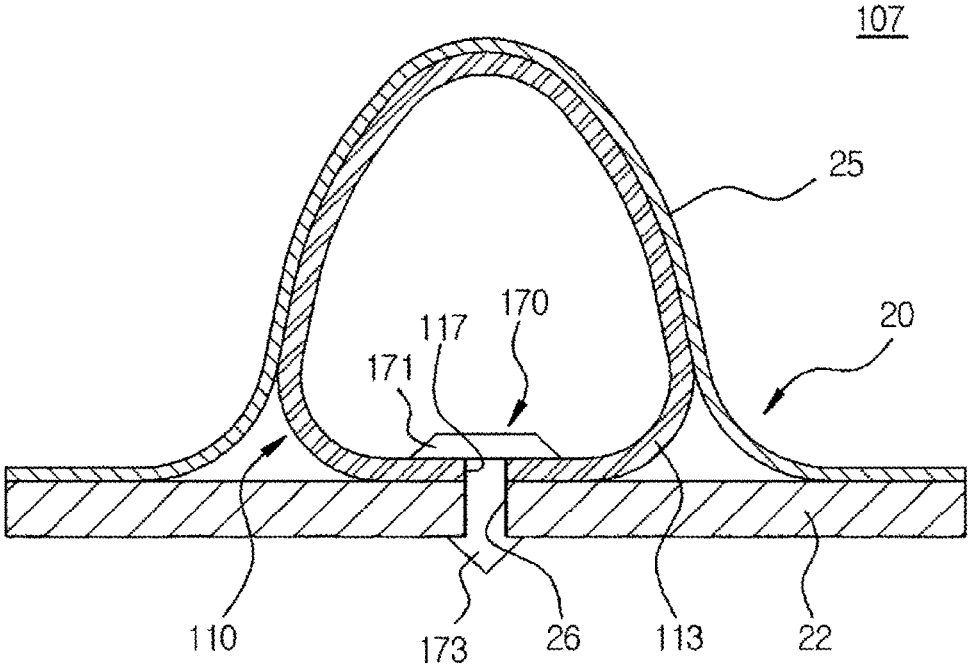
Figure 16:
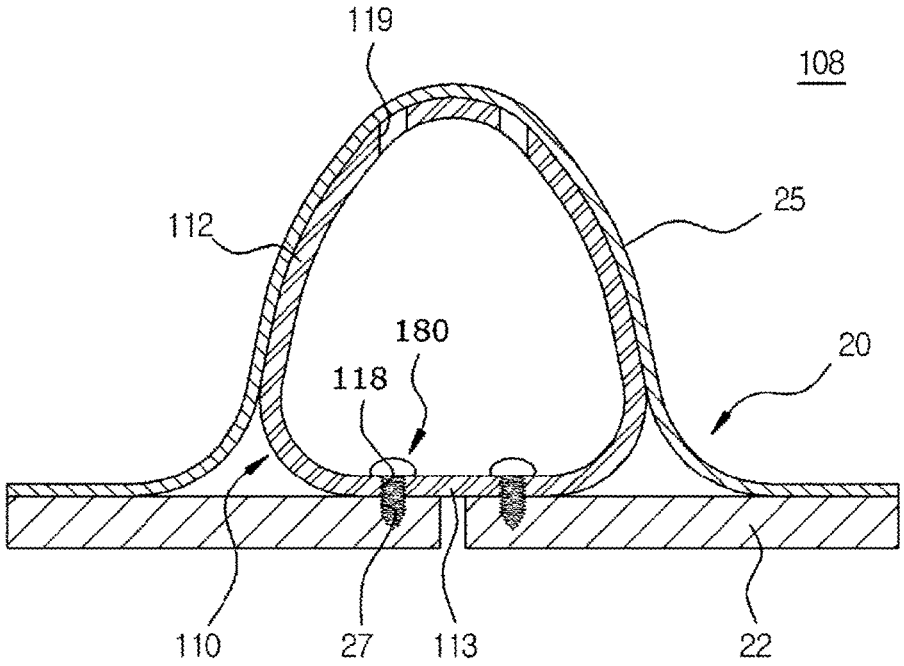

FIG. 14 to FIG. 16, which are respective portions of yet other examples of modification of the membrane assembly in accordance with the fourth embodiment of the present invention, illustrate that the reinforcing member is fixed to the insulating structural member by a separate fixing means.

In a membrane assembly 106 shown in FIG. 14, the reinforcing member 110 is fixed by a hook-type fixing member 160 that is fixed at the insulating structural member 22. The hook-type fixing member 160 can be made of plastic, metal or other various materials that can fasten the reinforcing member 110.

The hook-type fixing member 160 can be coupled to the insulating structural member 22 by use of an adhesive, welding, or other mechanical methods, depending on its material. The hook-type fixing member 160 has a hook 161 that is vertically protruded from the surface 21 of the insulating structural member 22, and the reinforcing member 110 is fastened to the insulating structural member 22 by inserting the hook 161 into an insertion hole 116 formed at the bottom portion 113 of the reinforcing member 110.

A membrane assembly 107 shown in FIG. 15 uses a hook-type plug 170 as a fixing means. For coupling of the hook-type plug 170, an insertion hole 170 is formed at the bottom portion of the reinforcing member 110, and a coupling hole 26 is formed at the insulating structural member 22.

The hook-type plug 170 has a head portion 171, which is bigger than the insertion hole 117, and a hook 173, which is inserted into the coupling hole 26 to make it difficult to disengage. The hook-type plug 170 fastens the reinforcing member 110 to the insulating structural member 22 by being inserted to the coupling hole 26 through the insertion hole 117 inside the reinforcing member 110.

By using the hook-type fixing member 160 shown in FIG. 14 and the hook-type plug 170 shown in FIG. 15 as fixing means for fixing the reinforcing member 110 to the insulating structural member 22, the reinforcing member 110 can be readily fixed to the insulating structural member 22 without using a separate installation tool. The hook-type plug 160 illustrated in FIG. 15 can be furnished as a protrusion integrated with the bottom portion 113 of the reinforcing member 110.

A membrane assembly 108 shown in FIG. 16 uses a screw 180 for a fixing means. For coupling of the screw 180, an insertion hole 118 is formed at the bottom portion of the reinforcing member, and a screw hole 27 is formed at the insulating structural member 22. A through-hole 119 is formed at the supporting portion of the reinforcing member 110 in order to allow a tool for fastening the screw 180 to access the screw 180. While the reinforcing member 110 is placed on the insulating structural member 22, the screw 180 and the tool can be inserted through the through-hole 119.

As illustrated in FIG. 14 to FIG. 16, by mounting the reinforcing member 110 to the insulating structural member 22 in advance by use of fixing means such as the hook-type fixing member 160, the hook-type plug 170 and the screw 180, the pre-mounted reinforcing member 110 can function as a guide for positioning the corrugation 25 of the membrane 20. The fixing means for fixing the reinforcing member 110 inside the corrugation 25 can be used together with an adhesive.

Figure 17:
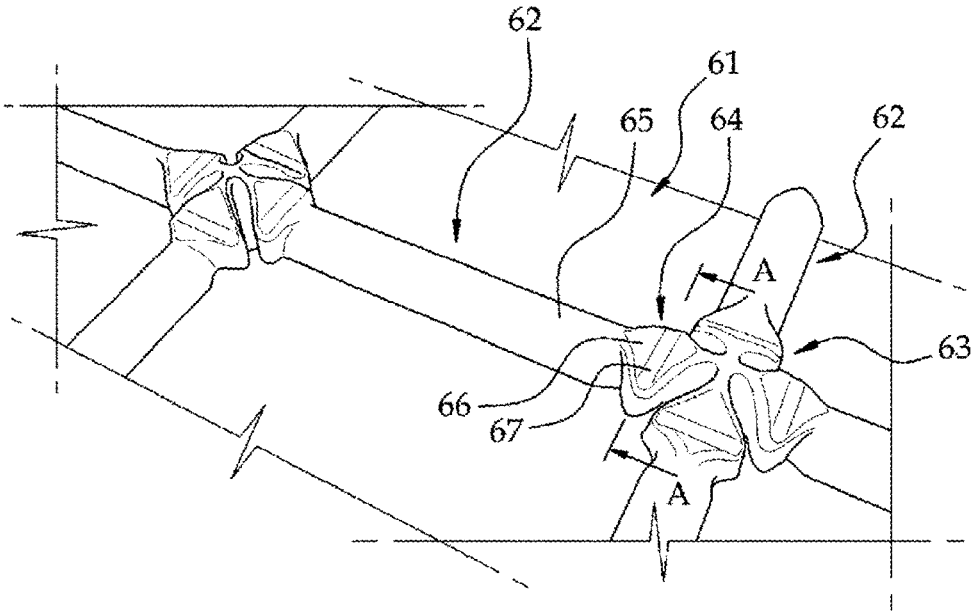
FIG. 17 is a perspective view of a membrane of a membrane assembly in accordance with a fifth embodiment of the present invention.
Figure 19:
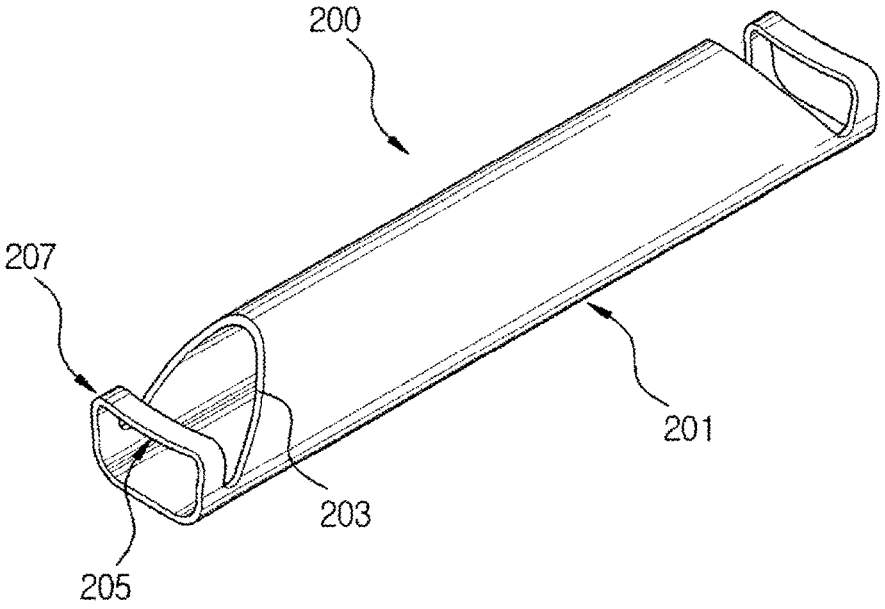
FIG. 19 to FIG. 21 are perspective views of reinforcing members for a membrane that can be coupled to the membrane illustrated in FIG. 17.
Figure 20:
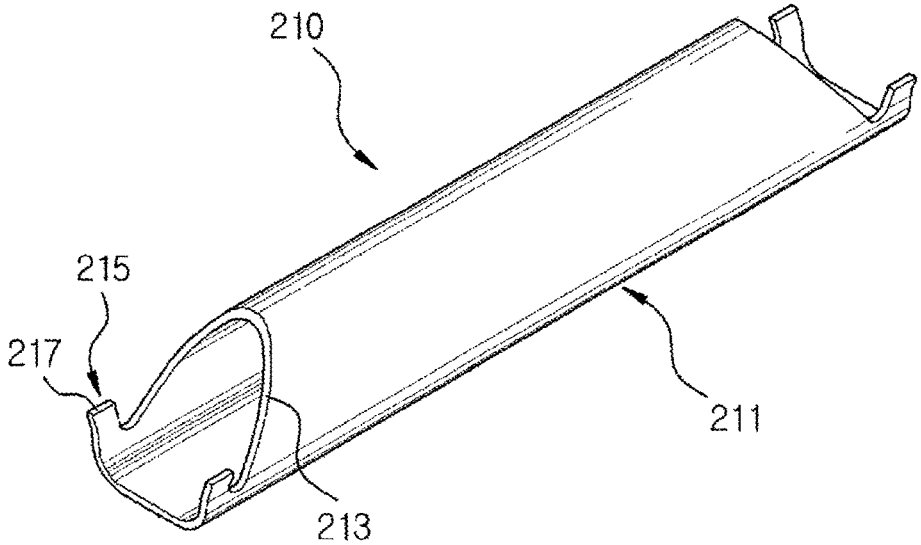
Figure 21:
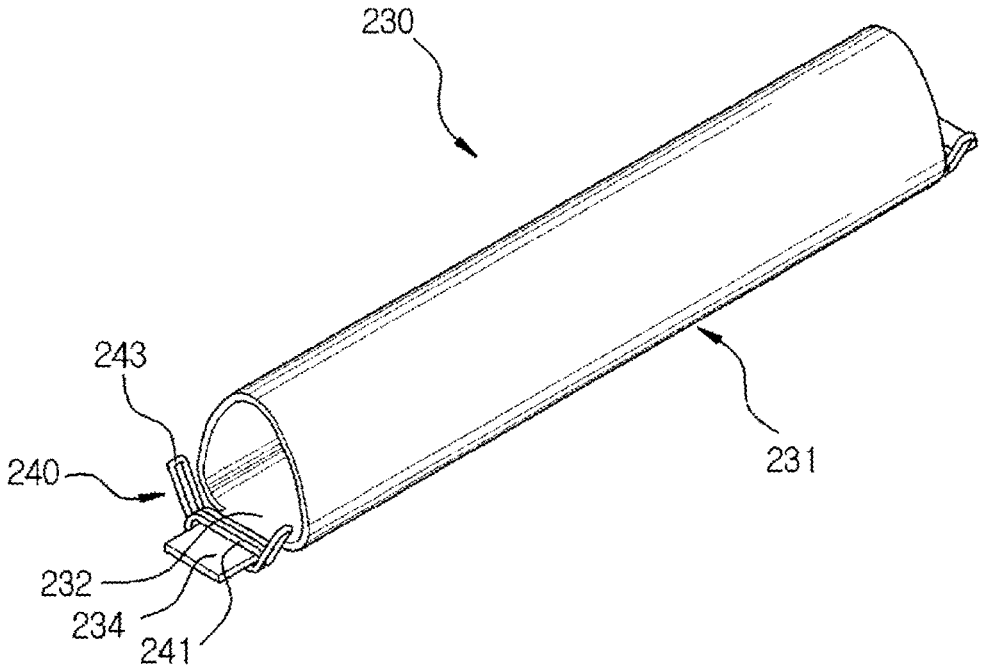

FIG. 17 shows a membrane of a membrane assembly in accordance with a fifth embodiment of the present invention, and FIG. 19 to FIG. 21 show various types of reinforcing members that can be coupled to the membrane shown in FIG. 17.

Figure 18:
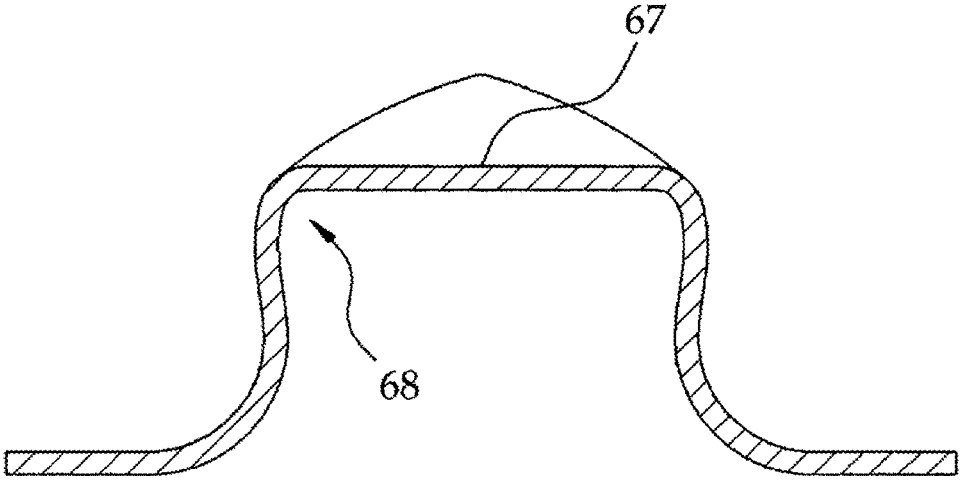
FIG. 18 is a sectional view along the A-A line of FIG. 17.

As illustrated in FIG. 17, arrange in a membrane 61 are a plurality of corrugations 62 that intersect with one another. Formed where the corrugations 62 intersect is a special type of intersection 63. A pair of concavities 64 are formed on either end of the corrugations 62 adjacent to the intersection 63. The concavity 64 is formed in the shape that a crest 65 of the corrugation 62 is caved in and spread in a lateral direction. The concavity 64 includes an undulation 66, which is gently declined from the crest 65, and a trough 67, which is connected at the bottom of the undulation 66. As illustrated in FIG. 18, the width of the trough 67 is greater than that of other portions, and a pair of concave surfaces 68 that are bent toward either lateral side are formed at the internal face of the trough 67.

The reinforcing members shown in FIG. 19 to FIG. 21 have pressure-type insertion means that can be in contact with the internal face of the concave surface 68 of the trough 67 and can be elastically deformed, and thus can be fixed to the membrane without any separate fixing means.

A reinforcing member 200 shown in FIG. 19 includes a reinforcing body 201 for supporting the internal face of the corrugation 62 and a pair of closed elastic deforming portions 205 disposed at either end of the reinforcing body 201. The closed elastic deforming portion 205 can be formed by incising a portion of an end of the reinforcing body 201 and pressing down a top portion to plastically deform either lateral side to protrude toward the outside.

A pair of latches 207 protruded toward the outside are formed on either lateral side of the closed elastic deforming portion 205. The latches 207, which correspond to the pair of concave surfaces 68 of the corrugation 62, can be pressed into the concave surface 68 to be plastically deformed so as to fix the reinforcing body 201 inside the corrugation 62. Formed at either end of the reinforcing body can be slopes 203 corresponding to the undulations 66 formed at either end of the corrugation 62.

A reinforcing member 201 shown in FIG. 20 includes a reinforcing body 211 for supporting the internal face of the corrugation 62 and a pair of open elastic deforming portions 215 furnished at either end of the reinforcing body 211. The open elastic deforming portion 215 can be formed in an integrated manner with the reinforcing body 215 by incising and deforming a portion of the reinforcing body 211. An externally bent latch 217 is furnished at an end of the open elastic deforming portion 215, and the reinforcing body 211 can be fixed inside the corrugation 62 without any separate fixing means by pressing the latch 217 into the concave surface 68 of the corrugation 62. Slopes 213 corresponding to the undulations 66 of the corrugation 62 are formed at either end of the reinforcing body 211.

The closed elastic deforming portion 205 or open elastic deforming portion 215 in accordance with the present invention is not restricted to what portions of the reinforcing body 201, 211 are deformed as illustrated and described. That is, it is also possible that the closed elastic deforming portion 205 or open elastic deforming portion 215 is separately fabricated and then coupled to the reinforcing body 201, 211.

A reinforcing member 230 shown in FIG. 21 is furnished with a pair of expanding clips 240, which are pressing-in means, at either end of a reinforcing body 231. The reinforcing member 230 includes an extension 234 for coupling the expanding clip 240. The extension 234 is protruded toward the outside from a bottom portion 232 of the reinforcing body 231. The expanding clip 240 includes a coil portion 241, which is wound on the extension 234, and a pair of arms 243 extended toward the internal face of the corrugation 62 from either end of the coil portion 241 so that the expanding clip 240 can be in contact with the internal face of the corrugation 62 and plastically deformed. When the reinforcing member 230 is inserted into the corrugation 62, the reinforcing member 230 can be fixed to the inside of the corrugation 62 by having ends of the arms 243 to be in contact with the concave face 68 of the corrugation 62 and plastically deforming the clip 240

Since the reinforcing members 200, 210, 230 shown in FIGS. 19 to 21 have pressing-in means that are in contact with the corrugation and plastically deformed, the reinforcing members 200, 210, 230 can be fixed inside the corrugation 62 without an adhesive or a separate fixing means. Therefore, the rigidity of the corrugation 62 can be reinforced by installing the reinforcing member with a conventional construction method without any structural modification of the insulating structural member 22.

What is claimed is:

1. A liquefied gas cargo tank having:

at least one wall, the wall including a membrane having at least one upwardly convex corrugation which is upwardly convexed and protruding toward an internal face of the cargo tank; and an insulating structural member being disposed adjacent to the membrane, the membrane being in contact with a product accommodated in the cargo tank;

a reinforcing member being disposed between the at least one upwardly convexed corrugation and the insulating structural member, wherein the reinforcing member being a one-piece component having a cross-sectional shape of a closed curve, wherein the reinforcing member includes:

a flat bottom portion of an external face being so flat that the flat bottom portion can be in contact with the insulating structural member; and a supporting portion having an external face corresponding to an internal face of the at least one upwardly convexed corrugation so that the supporting portion can be in contact with the internal face of the at least one upwardly convexed corrugation; and a plurality of reinforcing spokes being disposed inside the reinforcing member and supporting an internal face of the reinforcing member, the plurality of reinforcing spokes being radially placed from a center of the reinforcing member toward the internal face of the reinforcing member, including a vertical spoke passing through the center connecting an apex and the flat bottom portion of the reinforcing member, wherein the at least one upwardly convexed corrugation is disposed over an opening formed in the insulating structural member.

* * * * *